US005848548A

United States Patent [19]

Latour et al.

[11] Patent Number: 5,848,548

[45] Date of Patent: Dec. 15, 1998

[54] METHOD OF FORMING AT LEAST TWO CARPET FASTENER STRIPS FROM A SINGLE SHEET OF SHEET METAL

[76] Inventors: Lawrence J. Latour, 825 Jackson St.; Cliford J. Naquin, 621 St. Phillip, both of Thibodaux, La. 70301

[21] Appl. No.: 862,107

[22] Filed: May 22, 1997

Related U.S. Application Data

[63] Continuation-in-part of Ser. No. 904,047, Jun. 19, 1992, Pat. No. 5,661,874.

[51] Int. Cl.[6] ..... B21D 28/10

[52] U.S. Cl. ..... 72/325; 72/338; 29/415

[58] Field of Search ..... 72/330, 331, 337, 72/325, 338; 29/415, 412; 16/16, 4

[56] References Cited

U.S. PATENT DOCUMENTS

| | | | |
|---|---|---|---|
| 1,741,423 | 12/1929 | Lachman | 29/415 |
| 1,770,215 | 7/1930 | McIntyre . | |
| 2,299,936 | 10/1942 | Smith et al. | 29/415 |
| 2,611,918 | 9/1952 | Jaasund | 16/16 |
| 2,995,769 | 8/1961 | Hill . | |
| 3,395,420 | 8/1968 | Hill | 16/16 |
| 3,670,360 | 6/1972 | Hill | 16/16 |
| 3,683,738 | 8/1972 | Kyriakos | 16/16 |
| 3,828,391 | 8/1974 | Sutton et al. | 16/16 |
| 3,962,900 | 6/1976 | Leiblich | 29/415 |
| 3,997,937 | 12/1976 | Manguso | 16/16 |
| 4,682,925 | 7/1987 | Shields | 16/16 |
| 4,759,096 | 7/1988 | Dorris | 16/16 |
| 5,500,980 | 3/1996 | Morrow et al. | 16/16 |
| 5,584,149 | 12/1996 | Wilson | 16/16 |

*Primary Examiner*—Daniel C. Crane
*Attorney, Agent, or Firm*—C. Emmett Pugh; Pugh/Associates

[57] ABSTRACT

A carpet fastening system and method of manufacture in which an exemplary two, complementary, substantially identical carpet fastening strips are fashioned along side, but opposed to, one another in interdigitated fashion from a single, longitudinally elongated or extended section of flat sheet metal in a cutting-bending process, each of which fastening strips (100, 200 & 300) is ultimately affixed to the back-side of the a wall board (10) or to a wall baseboard (8), preferably with its wall engagement tabs (101, 201 & 301) being substantially flat, presenting either a flat, face-to-face, extended surface interface (FIGS. 1A & 2A) with the back-side of the wall or at least preferably a continuous or at least substantially extended edge (FIG. 3A) in engagement with the back-side, bottom edge of the wall baseboard, in order to secure "wall-to-wall" type carpeting about the walls. The strips are manufactured so as to be installed either at the same time as the baseboards are installed or even when the wall boards are being installed. As a result of manufacturing two complementary strips from a single piece of metal, the manufacturing and material costs and installation costs are reduced, making the metal fastener a cost-effective, superior replacement for the wooden carpet fastening systems of the prior art. The wall engaging tabs and the gaped spaces between them all have equal widths.

14 Claims, 6 Drawing Sheets

100
101
102
103
105
200
201
202
203
204
205
300
301
302
303
3
4
6

METHOD OF FORMING AT LEAST TWO CARPET FASTENER STRIPS FROM A SINGLE SHEET OF SHEET METAL

RELATED APPLICATION

This application is a continuation-in-part of U.S. patent application Ser. No. 07/904,047, filed Jun. 19, 1992 and entitled "Carpet Fastening System," being issued as U.S. Pat. No. 5,661,874 on Sep. 2, 1997, the disclosure of which is hereby incorporated herein by reference.

TECHNICAL FIELD

The present invention relates to carpet fastening systems and their method of manufacture, which systems are typically used to fasten carpets to the floor, typically along the periphery of the walls of a house, office or other building. More particularly, the present invention is directed a carpet fastening strip and its method of manufacture such that it is affixed to the wall at the back-side of the wall or the wall baseboard, at regularly spaced intervals defined by wall engaging tabs, rather than being affixed to the floor, and is preferably installed when, for example, the baseboards or even when the walls are installed. The strips are manufactured using a sheet of, for example, metal from which a pair of complementary fastening strips are fashioned without waste so as to reduce manufacturing and material costs and reduce the weight of the strip, thereby increasing the ease with which it is handled.

BACKGROUND ART

In the prior art typically in use in the housing construction and carpet installation industries, wooden "tack strips" with nails or other sharp projections sticking up through them are used to fasten carpet to floors at the periphery edges of the wall. These tack strips have to be nailed or glued to the floor surface, which is time consuming and accordingly relatively expensive.

Additionally, in some instances the concrete surface of the floor becomes so hard that it is very difficult to nail the tack strip to the concrete. When this happens the concrete typically cracks and chips.

With respect to metal fasteners, they are more expensive to manufacture than the wooden tack strips and are heavier making them more cumbersome to install and handle. Therefore, a method of manufacturing a metal carpet fastener that overcomes the limitations of the prior art while being cost-effective and relatively lightweight is a significant improvement over the prior art.

Some prior art patents which may be of interest are:

| Patent No. | Inventor | Issue Date |
|---|---|---|
| 5,500,980 | Morrow et al. | 26 MAR 1996 |
| 4,759,096 | Dorris | 26 JUL 1988 |
| 4,682,925 | Shields | 28 JUL 1987 |
| 3,997,937 | Manguso | 21 DEC 1976 |
| 3,962,900 | Leiblich | 15 JUN 1976 |
| 3,828,391 | Sutton et al. | 13 AUG 1974 |
| 2,995,769 | Hill | 15 AUG 1961 |
| 2,299,936 | Smith et al. | 27 OCT 1942 |
| 1,770,215 | McIntyre | 08 JUL 1930 |
| 1,741,423 | Lachman | 31 DEC 1929 |

It is noted that some of the afore-listed patents are from disparate, nonanalogous arts and not from the art to which the present invention pertains.

The Lachman (U.S. Pat. No. 1,741,423) patent discloses a flanged girder beam and its method of production that utilizes a rolled channel bar which is cut along a zigzag longitudinal line to form two identical halves with inwardly facing triangular projections. The two halves are aligned so that the tips of the triangular projections touch. The two halves are then attached to each other via coupling plates and/or rivets. While the channel-bar is flanged on the ends, there are no other raised surfaces on the bar. Therefore the identity of the two halves is maintained which is in contrast to the present invention.

The McIntyre (U.S. Pat. No. 1,770,215) patent discloses a carpet fastening system. The system is comprised of a raised channel member which is the anchoring strip and is provided with triangular shaped protruding tines for engaging the lower surface of the carpet. There is a lowered channel surface for receiving a base board and a rear flange for attaching to the wall. There is no method of manufacture disclosed nor any cut-out sections susceptible to the method of manufacture of the present invention.

The Smith et al (U.S. Pat. No. 2,299,936) patent discloses a method of manufacturing slide fasteners that incorporates cutting a single piece of stock to make longitudinal strips that have mating cutouts and separating the two strips. One strip then has a cavity formed and the other a lip. Both strips are then trimmed and burnished.

In contrast to the present invention, the two strips are not treated identically. They are formed so as to have interlocking cavities and lips. The system of the present invention treats both strips, once cut, identically. They are to be used each in the same fashion, in longitudinal alignment, and not as an interlocking pair.

The Hill (U.S. Pat. No. 2,995,769) patent is similar to McIntyre in that a similar carpet fastener system is provided yet no method of manufacture is provided that utilizes a single sheet of material to cut out two complementary fastener strips.

The Leiblich (U.S. Pat. No. 3,962,900) patent discloses a fence post and its method of production. The post is formed from sheet metal blanks and is comprised of a body portion and tongue and recess portions which are complementary to each other. The tongues are subsequently formed to curl back toward the body portion of the post.

The Shields (U.S. Pat. No. 4,682,925) patent discloses an upholstery tacking device which is comprised of an upper, slotted flange and a lower tabbed flange perpendicular to the upper flange. The lower flange has perforations on each tab to grasp the upholstery. Once the upholstery is grasped by the perforations the tab is bent towards the upper flange to completely secure the upholstery. No particular method of manufacture is disclosed that would include the manufacturing of multiple strips which are subsequently separated.

The Morrow et al (U.S. Pat. No. 5,500,980) patent discloses another carpet securing device made of polymeric material using a conventional extruder. The fasteners have a flat top surface, a bottom surface with a longitudinally extending groove, an inclined side edge and a vertical side edge. A method of manufacture is taught that forms a sheet of fifteen (15) fastener strips with the grooves formed alternately on the top and bottom surfaces. A slitter cuts alternately the vertical side and the inclined side. Therefore in looking at a cross-section of the fifteen strips (see FIG. 6 of the patent) alternating strips are upside down which is in contrast to the present invention.

The Dorris, Sutton, and Manguso patents are not directed towards a method of manufacturing a carpet fastening system but rather are directed to carpet fasteners themselves, and as such are included only for general background information.

GENERAL DISCUSSION OF INVENTION

The present invention is thus directed to a carpet fastening system and its method of manufacture which carpet fastening system is used to fasten carpets to the floor typically along the periphery of the walls of a house, office or other building. More particularly, the present invention is directed to a method of manufacturing a carpet fastening strip so that multiple (e.g. two), complementary fastening strips are formed from a single sheet of metal.

The method of manufacture utilizes a bent sheet of, for example, sheet metal. The sheet of metal may be formed or bent by a rolling process or other suitable forming processes. The fastening system is designed so that, for example, two fastening strips are complementary and may be formed from a single sheet of metal with substantially no waste or at least greatly reduced waste and cost savings, but while each strip is superior to the prior art "tacking strip".

A single strip of sheet metal is cut so as to form two complementary carpet fastener strips. The strips are then rolled to create the striated surface of the fasteners. Essentially, once cut, if one strip is rotated one hundred and eighty (180°) degrees with respect to the other, the strips are then identical.

In order to appreciate the importance of the manufacturing method to creating a cost-effective, lighter weight, and more durable carpet fastener, the carpet fasteners themselves must be described in some detail.

For ease in installation, the fastening strips of the invention are preferably installed at the same time as the baseboards are installed or even when the wall boards are being installed.

As a result of engaging the back-side of the wall, the fastening strips are firmly affixed to the wall and provide secure, strong affixation to the wall, anchoring the strips and hence the carpet, preventing any migration of the carpet during its typically expected life-time and longer.

In a first, exemplary embodiment the wall engaging tabs of the fastening strip are basically "L" shaped in their side, cross-sectional configuration, with the stem of the "L" being inserted behind, for example, the wall board (made e.g. of sheetrock) and the base of the "L" forming a bridging portion to a carpeting engaging portion of the strip. In a second, exemplary embodiment the wall engaging tab forms (in a sense) two, stacked "L's", with the stem of the top "L" placed behind, for example, the baseboard and the horizontally extending stem of the top "L" engaging the underside of the bottom of the baseboard.

These first two, exemplary embodiments both provide a flat, extended surface, face-to-face, surface engagement with the back-side of the wall, either by being in such contact with the back-side of the wall board (1st embodiment) or the back-side of the wall baseboard. The second embodiment further provides a base for ease in relatively positioning the wall engaging portion of the fastening strip correctly with the baseboard.

In a third, exemplary embodiment of the fastening strip the wall engaging tab is likewise preferably flat but only engages the back-side of the lower edge of the baseboard with preferably a straight-line edge engagement.

In all cases, when a force is applied to the fastening strip in a direction to provide a tendency to pull it away from the wall, the force causes the movement resistance engagement of the strip to proportionately increase due to its straight-line or flat, face-to-face interfacing with the back-side of the wall. Further, the use of wall engaging tabs allows for the fasteners to be manufactured in complementary pairs, saving time, lessening their weight, increasing the ease with which they may be installed, and decreasing their overall cost.

The invention preferably provides a method of manufacturing such carpet fasteners for attaching a carpet to a wall, with or without a baseboard, and preferably without needing to use nails or glue on the floor. Additionally, it is contemplated that the present invention will eliminate the problems that are prevalent with the prior art.

The use of the invention is expected to save valuable time and money and be less trouble to install than the systems of the prior art. Additionally, the system of the invention provides significant advantages, inter alia, in replacing damaged carpet caused by flooding and the like.

It is therefore an object of the present invention to provide a method of manufacturing a carpet installation and fastening system which will save time in manufacturing and installing, will be less costly, and yet provide a more secure, reliable, and enduring anchoring system for the carpet, particularly at its peripheral edges with the walls of a house, office or other building.

It is another object of the present invention to preferably provide such a manufacturing method using a sheet of metal to produce multiple (at least two), complementary, fasteners with, for example, substantially flat, wall engaging tabs, providing a flat, face-to-face surface engagement with the back-side of the wall.

It is a further object of the invention to provide a method of manufacturing metal carpet fasteners that is cost-effective from a materials standpoint and is relatively lightweight for a metal fastener.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a perspective, partially cut-away view of a first, exemplary embodiment of the over-all carpet fastening system of the present invention, in which the wall engaging tabs of the fastening strip interface with the back-side of the bottom part of the wall board and is sandwiched between it and a "two by four" plate, with the carpet and its backing fastened in position under the anchoring action of the fastening strip; while

FIG. 2 is a perspective, partially cut-away view of a second, exemplary embodiment of the over-all carpet fastening system of the present invention, in which the wall engaging tabs of the fastening strip interface with the back-side of the bottom part of the wall baseboard and are sandwiched between it and the wall board, with the carpet and its backing fastened in position under the anchoring action of the fastening strip; while

FIG. 3 is a perspective, partially cut-away view of a third, exemplary embodiment of the over-all carpet fastening system of the present invention, in which the wall engaging tabs of the fastening strip interface with the back-side of the bottom part of the wall baseboard and provide a straight edge engagement with the back-side of the baseboard, with the carpet and its backing fastened in position under the anchoring action of the fastening strip; while

MODES FOR CARRYING OUT THE INVENTION

Figure 1:
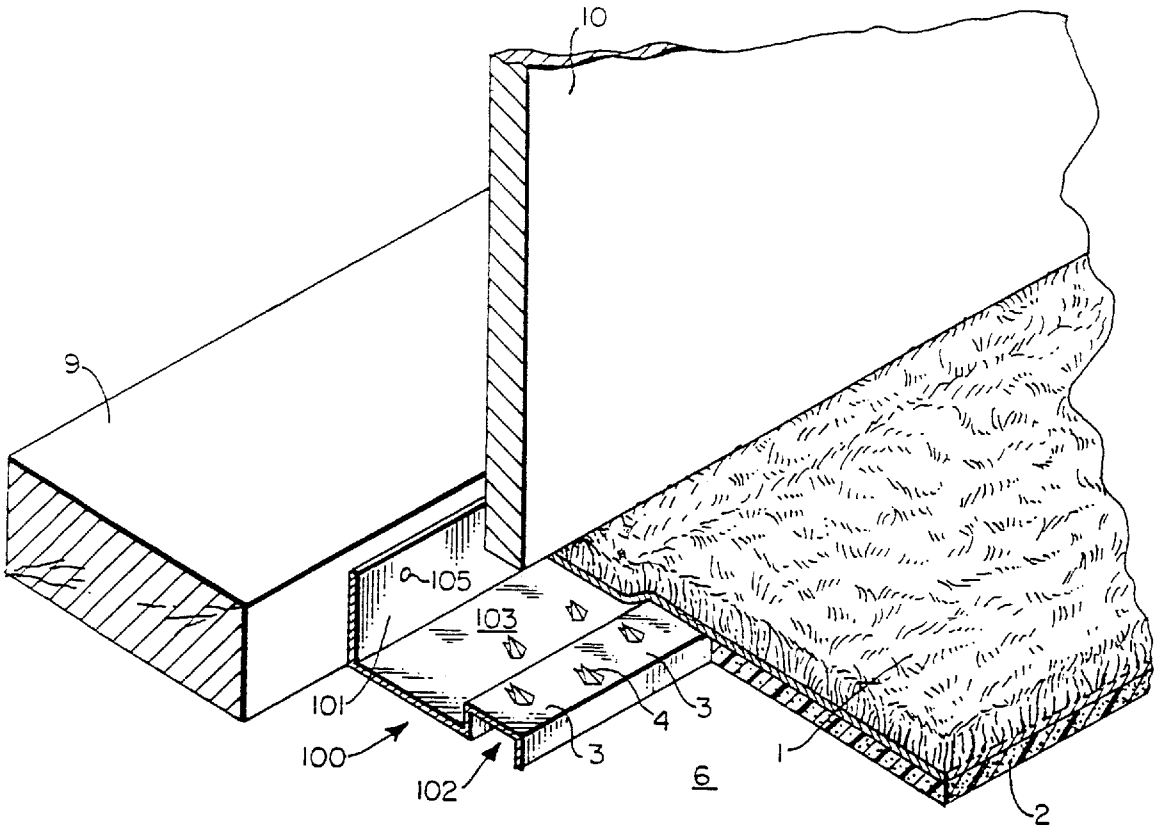

1st Embodiment (FIG. 1+)

As can be seen in FIGS. 1 and FIGS. 1A, 1B and 1C the initial, exemplary embodiment of the over-all carpet fastening system of the present invention includes a first exemplary embodiment of the fastening strip 100 in which there are three portions, wall engaging tabs 101, a carpet securing, base portion 102 and a bridging portion 103 between them, all integrally formed together out of, for example, a single piece of bent sheet metal.

As can be clearly seen in the figures, the wall engaging tabs 101 engage in flat, face-to-face, extended surface engagement the back-side of the wall board 10, which can be, for example, drywall or sheet rock (e.g. ½" thickness). As a result the wall engaging tabs are actually sandwiched between the wall board 10 and the exemplary "2×4" wood floor plate 9, which is usually secured to the floor 6 usually by nailing. This causes the fastening strip 100 to be securely affixed and anchored to the wall.

As a result the carpet 1 and its underlayment backing 2 is securely held and anchored in place along the periphery of the floor or where ever the anchoring strip 100 is placed, which in the illustrated design would typically be placed along the wall parallel to it with the wall engaging portion juxtaposed to the wall and outboard of the carpet securing, base portion 102. The carpet securing, base portion 102 preferably is raised with respect to the bridging portion 103, forming a plateau with respect to it and having preferably an inverted, squared-off "U" shape in its side configuration (note particularly FIG. 1A). The sides of the "U" shape are formed by 102A and 102B as shown in FIG. 1C.

At least the carpet securing, base portion 102 includes a series of spaced spikes 4 which protrude up and stick into the underside of the backing 2 and carpet 1, holding them in place. However, the bridging portion 103, as illustrated, likewise includes some spikes 4 piercingly engaging the underside of the backing and carpet. It is noted that the sides of the spikes 4 preferably form the bases of intersecting triangular surfaces meeting at a common vertex. This design provides, not only significant carpet piercing capability, but also has great strength in contrast to those of the prior art which typically includes only a single stamped out, relatively flat panel.

Figure 1A:
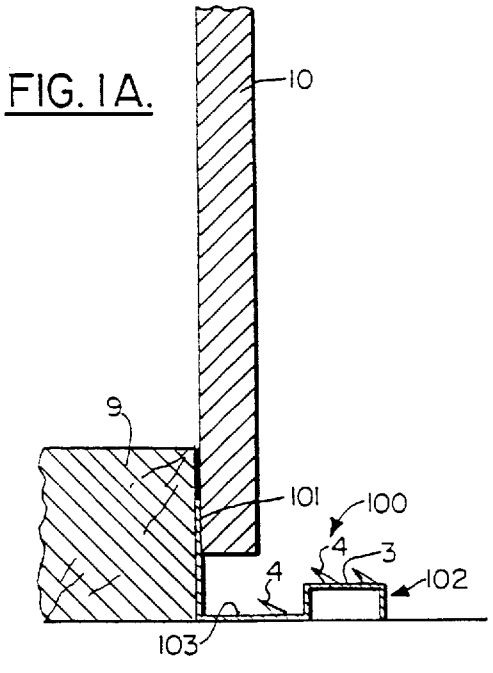
FIGS. 1A & 1B are side and perspective views, respectively, of the embodiment of FIG. 1, with the former including the wall and the latter showing only the fastening strip itself.

As shown in the drawings, a series of nail holes 105 are included along the width or lateral extent of the wall engaging portion 101 to allow the fastening strip 100 to be preliminarily attached or "tacked" to the base plate 9, while awaiting for the addition and nailing of the wall board 10 to the base plate to complete up the "sandwich" arrangement illustrated in FIG. 1A.

This embodiment thus can be installed with the installation of the wall plates 9, i.e., well before the wall baseboards, or preferably in conjunction with the installation of the wall baseboards 8.

This first embodiment, and the other two embodiments described below, are all made using a method of manufacturing that allows for a multiple number, for example, at least two (2) of the fastening strips to be fashioned out of one piece of sheet metal with no waste, with the two strips being complementary to one another, that is, one is made along side the other with complementing, interdigitating areas, which when separated from one another and with one of them flipped over to the side of the other, are substantially identical.

As shown in FIG. 1C, a single, relatively flat sheet of sheet metal may be cut along line "x" (also indicated in bold) to form multiple or more particularly an exemplary, two complementary fastening strips, which, as noted, are substantially identical to one another. The cut sections of the strips are longitudinally displaced a distance equal to the length of one wall engaging tab 101, with the length in between tabs being equal to the length of the tabs. The other lines are fold lines. about which folds or bends are made in the sheet metal sheet to produce the carpet fastening strips described in detail herein.

As can be seen with reference to the drawings, the relatively flat sheet metal is cut along the "x" lines, starting at a position slightly off from the central portion, that is, that portion adjacent to the center-line of the longitudinally extended flat sheet, and further cutting in a longitudinal direction a first length, then cutting in a latitudinal or lateral direction towards the central portion a second length, and cutting again in the same longitudinal direction a first length, and lastly in an opposite latitudinal direction a second length, forming two complementary carpet fastener strips, which has yet to be bent into its final shape. The foregoing cutting step is repeated a multiple number of times forming a desired length of carpet fastener strips formed along side, but opposed to, one another in interdigitated fashion, with the wall engaging portions having a width and being spaced along the length of the base portion by a series of gaps, the widths of the gaps and the widths of the wall engaging portions being equal. Finally, the resulting carpet fastener strips are each then bent along the various fold lines shown in the drawings to fully form the base portion and the series of wall engaging tabs or spaced portions capable of affixing the base portion to the wall and/or its affiliated base board (which is part of the wall), with the base portion holding the carpet in place on the floor along the wall.

Typically, the sheet metal will be supplied to the strip manufacturer in a roll form, which is unrolled prior to the foregoing cutting, separating and bending steps. The roll can be cut by either the sheet metal manufacturer or the fastening strip manufacturer into sub-sectioned rolls of desired widths, for example, of a width which would result in the production of two, complementary strips from each sub-sectioned roll. Alternatively, the full roll or a different width of sub-sectioned roll could be used to be fed and continuously produce more than two, complementary strips, but typically this would be done to produce even numbers of complementary strips, e.g., two (2), four (4), six (6), eight (8), etc.

An exemplary gauge for the sheet metal is twenty-eight gauge of galvanized sheet metal, although the particular material and its thickness of the material for the fastening strips is subject to significant variation, with, inter alia, cost and strength factors being involved. Exemplary rolls for the sheet metal come in exemplary sizes of, for example, thirty (30") inch widths weighing a number of tons [e.g. five (5) tons], which widths can be cut down to, for example, five (5") inch wide, sub-sectioned rolls.

The press cutting step(s) and punching steps for the projections 4 can be continuously performed from the selected size roll, producing strips of a very extended length, which are then laterally cut with, for example, a press cut across the full width to produce the desired strip lengths, with the bending along the fold lines being done concurrently or in a separate set of subsequent steps. The desired bending can be performed by a stamping machine in a one step process or a bending machine can be used with produces the bends in a continuous, moving process.

If so desired, flat, cut, sheet metal strips of an appropriate width [e.g. five (5") inch width], and of a desired length, for example a length sufficient to produce, for example, four or more sets of opposed, side-by-side, dual fastening strips, could be supplied to the work site, which itself could have an appropriate cutting and stamping and/or punching machine which could be used to produce the final cut and bent fastening strips on site, in somewhat of a similar fashion to that done by aluminum extruding machines based on a truck which produce aluminum guttering for buildings on site from raw material. This approach would further simplify shipping of the semifinished product in simple flat, stacked form to builders, contractors and the like for the final manufacturing steps.

The methods of manufacturing the other two, exemplary embodiments of the carpet fastening strips in accordance with the principles of the present invention will now be described. However, for the sake of brevity, because many of the elements are the same (in which case identical reference numbers were used) or analogously the same (in which case analogous reference numbers were used), a description of all of them will not be provided, as such would merely be redundant.

Figure 2:
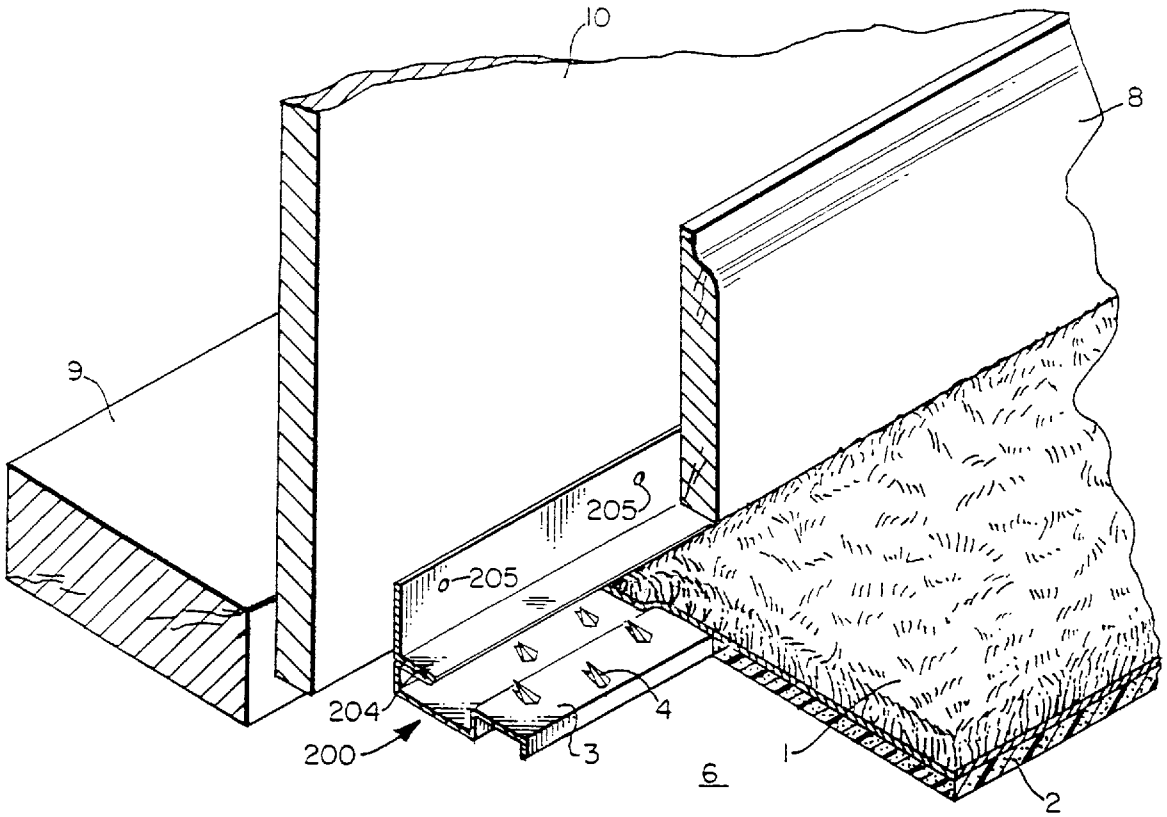

2nd Embodiment (FIG. 2+)

Figure 2A:
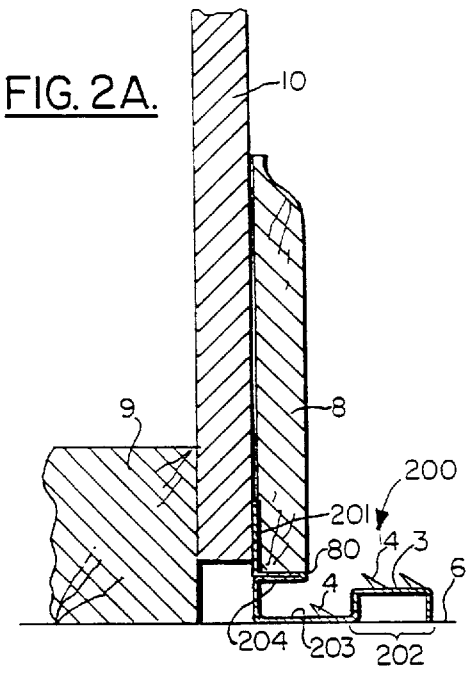
FIGS. 2A & 2B are side and perspective views, respectively, of the embodiment of FIG. 2, with the former including the wall and the latter showing only the fastening strip itself.
Figures 1B, 2B, 3B:
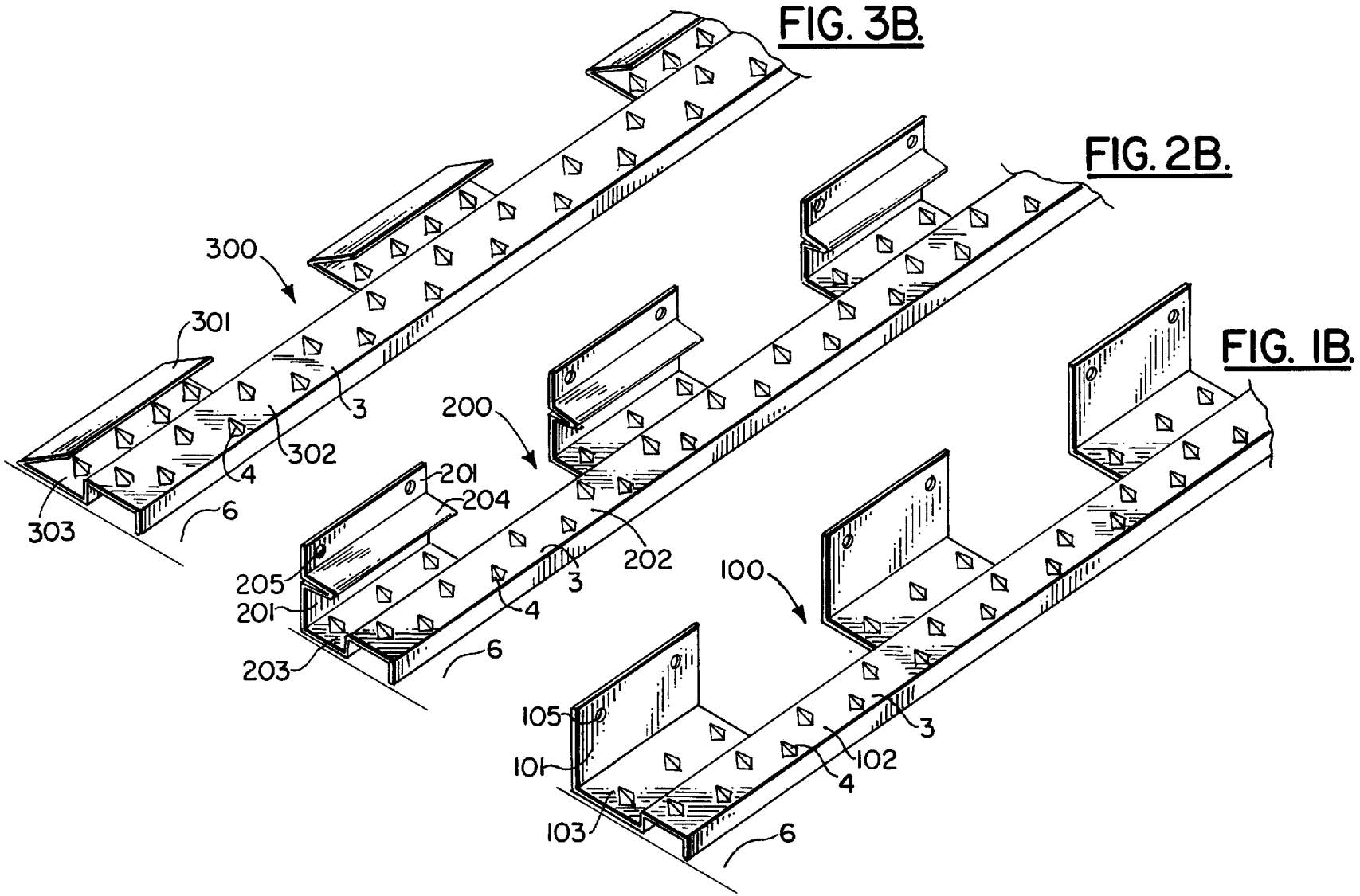
Figure 1C:
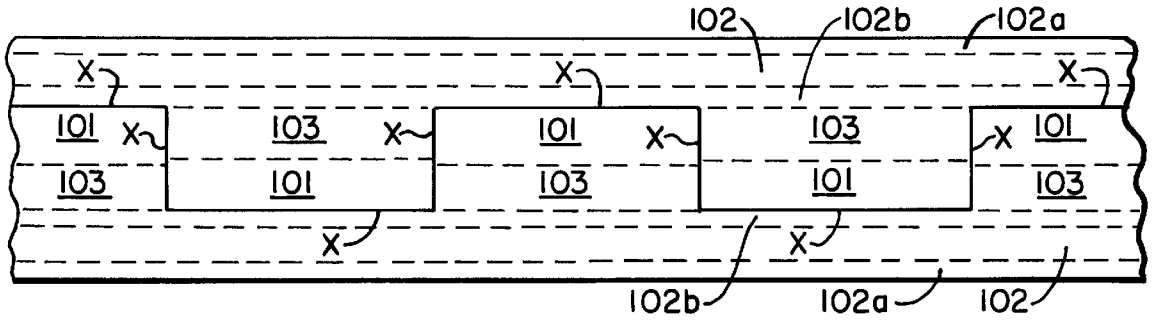
FIG. 1C is a plan view of an uncut piece of sheet metal with the outline of fold lines and cut lines of two fastening strips of the embodiment of FIG. 1.

As can be seen in FIGS. 2 and FIGS. 2A & 2B, a second, exemplary embodiment of the over-all carpet fastening system of the present invention includes a first exemplary embodiment of the fastening strip 200 in which there are three portions, wall engaging tabs 201, a carpet securing, base portion 202 and a bridging portion 203 between them, all integrally formed together.

The second, exemplary embodiment 200 of the fastening strip is very similar to the first embodiment 100, both in structure and in installation and use. However, one very significant difference is that the strip 200 includes an alignment and positioning gauge 204, which makes installation of the strip easier and eases the installation of the baseboard 8. Once the strip 200 has been preliminarily fastened or affixed to the wall board 10, the baseboard installer needs only to place the bottom or underside 80 of the baseboard on top of the horizontal platform provided by the gauge 204.

The platform or base gauge 204 is formed in the strip by merely including a horizontal fold-back during the bending or other forming of the strip 200. In essence, the inclusion of the fold or gauge 204 forms a double, stacked "L", one nested in the other, with the base of the upper "L" being formed by the gauge or platform 204, while the base of the lower, larger "L" is formed by the bridging portion 203.

Again, analogously to the first embodiment as described above, although not shown in the drawings, a series of nail holes could be included along the width or lateral extent of the wall engaging portion 201 to allow the fastening strip 200 to be preliminarily attached or "tacked" to the wall board 10, while awaiting the addition and nailing of the wall baseboard 8 to the wall board to complete the "sandwich" illustrated in FIG. 2A, which of course is different than that of FIG. 1A.

Figure 2C:
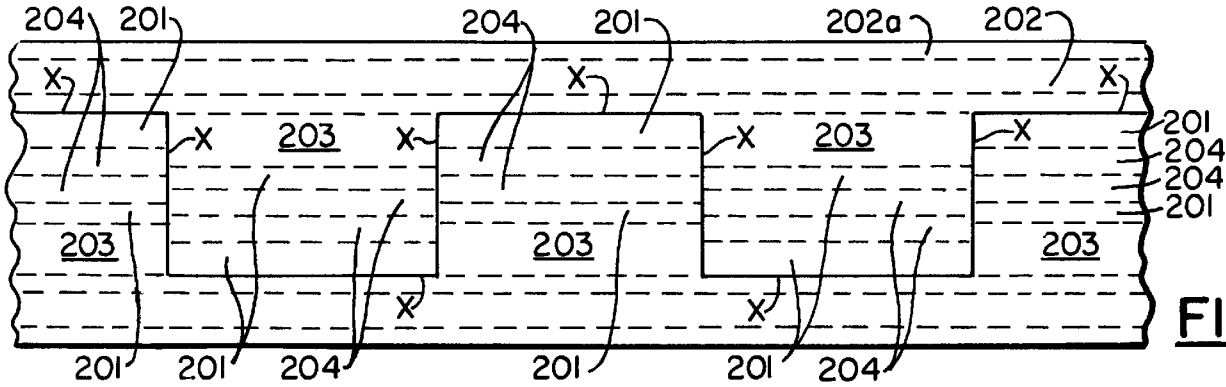
FIG. 2C is a plan view of an uncut piece of sheet metal with the outline of fold lines and cut lines of two fastening strips of the embodiment of FIG. 2.

As shown in FIG. 2C, the engaging tab 201 is formed in two sections, one which will extend up, parallel with the wall, and one that will extend down, also parallel with the wall, and the gauge 204 will extend out perpendicularly from the wall. Again, this embodiment is also first cut along line "x", and then appropriately bent.

Figure 3:
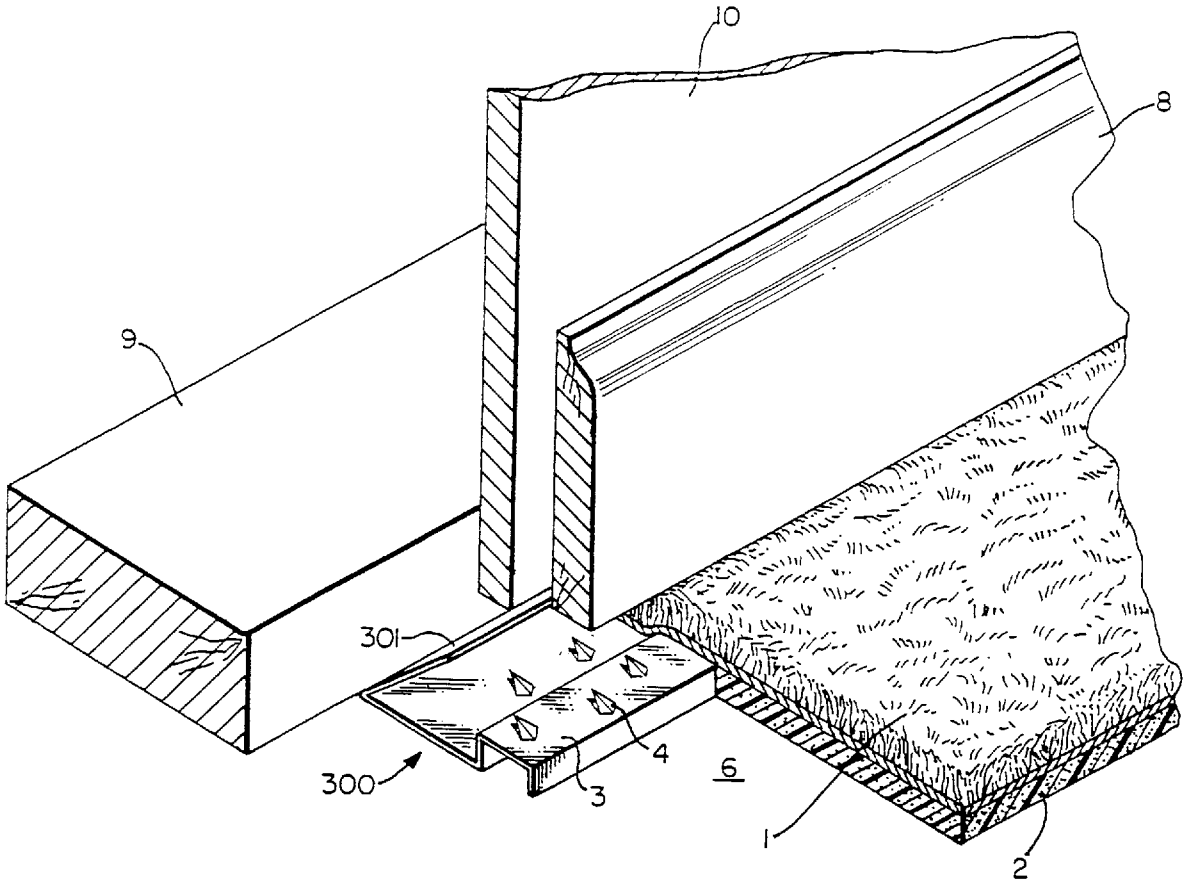

3rd Embodiment (FIG. 3+)

Figure 3A:
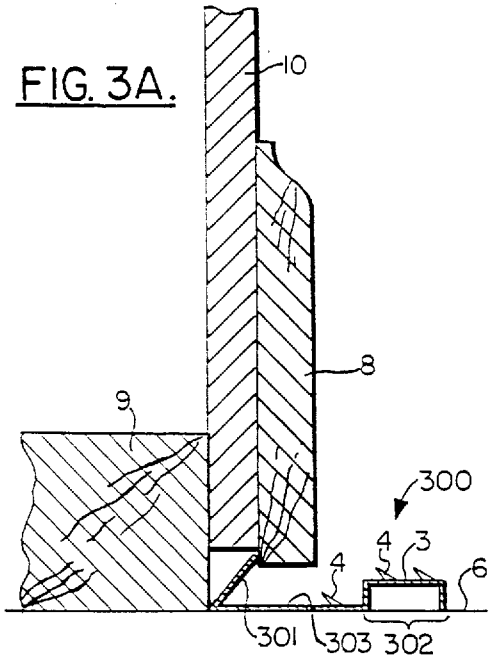
FIGS. 3A & 3B are side and perspective views, respectively, of the embodiment of FIG. 3, with the former including the wall and the latter showing only the fastening strip itself.

As can be seen in FIGS. 3 and FIGS. 3A & 3B, a third, exemplary embodiment of the over-all carpet fastening system of the present invention includes a first exemplary embodiment of the fastening strip 300 in which there are three portions, wall engaging tabs 301, a carpet securing, base portion 302 and a bridging portion 303 between them, all integrally formed together.

With respect to its carpet securing, base portion 302 and its bridging portion 303, it is substantively identical to the other two embodiments. However, its wall engaging tabs 301 are bent back over the bridging portion 302 at an angle of about forty-five (45°) degrees (note particularly FIG. 3A).

This allows its terminal edge to lockingly fit into the edge or lip formed between the intersection of the bottom, outer edge of the wall board 10 and the bottom, inner edge of the baseboard 8, which extends further lower down than the wall board. The combination thus preferably forms a continuous (at least extended) straight-edge to straight-edge interfacing engagement.

Figure 3C:
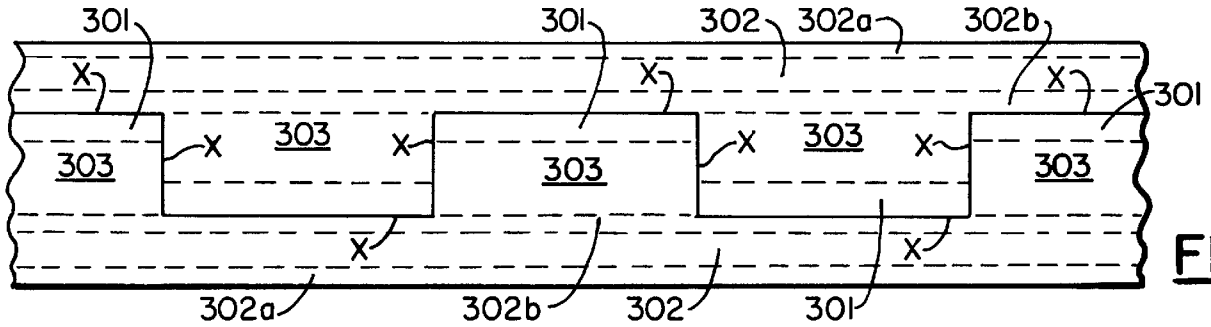
FIG. 3C is a plan view of an uncut piece of sheet metal with the outline of fold lines and cut lines of two fastening strips of the embodiment of FIG. 3.

FIG. 3C again illustrates the cut line "x", in bold, where each fastener is again cut first, then bent.

It is noted that the three embodiments and associated methodology described herein in detail for exemplary purposes are of course subject to many different variations in structure, design, application and methodology. Because many varying and different embodiments may be made within the scope of the inventive concept(s) herein taught, and because many modifications may be made in the embodiments and associated methodology herein detailed in accordance with the descriptive requirements of the law, it is to be understood that the details herein are to be interpreted as illustrative and not in a limiting sense.

We claim:

1. A method of manufacturing a carpet fastening system using a fastening strip with a base portion, and a series of wall engaging tabs for securing carpet about the periphery of a floor adjacent to a wall using the fastener strips, comprising the following steps:

a) providing a relatively flat sheet of sheet metal;

b) cutting the sheet metal to form at least two, complementary carpet fastener strips, with each strip when flipped over being substantially identical to the other;

c) bending each of the carpet fastener strips to form a base portion and a series of wall engaging tabs capable of affixing the base portion to the wall, effectively holding the carpet in place on the floor to the wall; and d) bending a bridging portion between the wall engaging tabs and said base portion, said bridging portion being flat and engageable on its underside in face-to-face surface interfacing with the upper surface of the floor.

2. The method of claim 1, wherein there is further included the step of:

bending said base portion to have an upper surface providing a raised plateau at a higher vertical level than said bridging portion.

3. The method of claim 2, wherein there is further included the step of:

bending said plateau of said base portion to form an inverted "U" in its side, cross-sectional configuration.

4. The method of claim 1, wherein there is further included the step of:

perforating said bridging portion with a series of upwardly extending pointed protrusions which can pierce the underside of the carpet.

5. The method of claim 1, wherein there is further included the step of:

perforating said bridging portion with a series of protrusions that comprise a set of at least two sides forming the bases of two intersecting triangular surfaces meeting at a common vertex.

6. The method of claim 5, wherein said perforating step further includes the step of:

punching or stamping out the protrusions from the material of said base portion.

7. The method of claim 2, wherein in step "b" there is further included the step of:

b-1) cutting the metal starting at a position slightly off from the central portion and cutting in a longitudinal direction a first length, then cutting in a latitudinal direction towards the central portion a second length, and cutting again in the same longitudinal direction a first length, and lastly in an opposite latitudinal direction a second length, forming two complementary carpet fastener strips; and wherein there is further included the step of:

e) repeating the cutting step "b" a multiple number of times forming a desired length of carpet fastener strips.

8. A method of manufacturing a carpet fastening system with a base portion, and a series of wall engaging tabs for securing carpet about the periphery of a floor adjacent to a wall, comprising the following steps:

a) providing a relatively flat sheet of sheet metal having a central portion:

b) cutting the metal starting at a position slightly off from the central portion and cutting in a longitudinal direction a first length, then cutting in a latitudinal direction towards the central portion a second length, and cutting again in the same longitudinal direction a first length, and lastly in an opposite latitudinal direction a second length, forming two complementary carpet fastener strips;

c) repeating the cutting step "b" a multiple number of times forming a desired length of carpet fastener strips;

d) bending the carpet fastener strips to form a base portion and a series of wall engaging tabs capable of affixing the base portion to the wall, with the base portion holding the carpet in place on the floor to the wall; and e) bending a bridging portion between said flat wall engaging tabs and said base portion, said bridging portion being flat and engageable on its underside in face-to-face surface interfacing with the upper surface of the floor; and f) bending said base portion to have an upper surface providing a raised plateau at a higher level than said bridging portion.

9. The method of claim 8, wherein there is further included the step of:

bending said plateau of said base portion to form an inverted "U" in its side, cross-sectional configuration.

10. The method of claim 8, wherein there is further included the step of:

perforating said bridging portion with a series of upwardly extending pointed protrusions which can pierce the underside of the carpet.

11. The method of claim 8, wherein there is further included the step of:

perforating said bridging portion with a series of protrusions that comprise a set of at least two sides forming the bases of two intersecting triangular surfaces meeting at a common vertex.

12. The method of claim 11, wherein said perforating step further includes the step of:

punching or stamping out the protrusions from the material of said base portion.

13. The method of claim 8, wherein there is further included a base plate behind the wall, and wherein there is further included the step of:

punching a series of laterally spaced nail holes through the wall engaging tabs for fastening the fastener strip to the base plate behind the wall.

14. The method of claim 8, wherein the wall includes a back-side and there is also included a baseboard for the wall, and wherein the bending step further includes the step of:

bending the carpet fasteners to form a series of wall engaging tabs with a projecting baseboard gauge capable of aligning said baseboard in its position next to the back-side of the wall, while said base portion holds the carpet in place on the floor beneath the projecting baseboard gauge.

* * * * *